US010289040B2

(12) United States Patent
Otsuka

(10) Patent No.: US 10,289,040 B2
(45) Date of Patent: May 14, 2019

(54) IMAGE FORMING APPARATUS, METHOD OF CONTROLLING IMAGE FORMING APPARATUS, AND PROGRAM

(71) Applicant: Konica Minolta, Inc., Tokyo (JP)

(72) Inventor: Yutaka Otsuka, Toyokawa (JP)

(73) Assignee: Konica Minolta, Inc., Tokyo (JP)

( * ) Notice: Subject to any disclaimer, the term of this patent is extended or adjusted under 35 U.S.C. 154(b) by 4 days.

(21) Appl. No.: 15/907,513

(22) Filed: Feb. 28, 2018

(65) Prior Publication Data

US 2018/0267446 A1 Sep. 20, 2018

(30) Foreign Application Priority Data

Mar. 17, 2017 (JP) ..... 2017-052411

(51) Int. Cl.
*G03G 15/20* (2006.01)
*G03G 15/00* (2006.01)

(52) U.S. Cl.
CPC ..... *G03G 15/2039* (2013.01); *G03G 15/20* (2013.01); *G03G 15/2057* (2013.01); *G03G 15/553* (2013.01); *G03G 15/206* (2013.01); *G03G 2215/2016* (2013.01)

(58) Field of Classification Search
CPC ..... G03G 15/2078; G03G 15/2064; G03G 2215/2016; G03G 2215/2025
See application file for complete search history.

(56) References Cited

U.S. PATENT DOCUMENTS

2016/0378034 A1* 12/2016 Taniguchi ..... G03G 15/502 399/81

FOREIGN PATENT DOCUMENTS

| | | | |
|---|---|---|---|
| JP | 2004233543 A | * | 8/2004 |
| JP | 2005-115221 A | | 4/2005 |
| JP | 2007025231 A | * | 2/2007 |
| JP | 2007-212844 A | | 8/2007 |
| JP | 2016-130823 A | | 7/2016 |

OTHER PUBLICATIONS

Minagawa (JP 2007-025231 A), Feb. 2007, JPO Computer Translation.*

* cited by examiner

*Primary Examiner* — Erika J Villaluna
(74) *Attorney, Agent, or Firm* — Osha Liang LLP

(57) ABSTRACT

An image forming apparatus includes: a fixing device having: a heating member having a heat source; a pressing member; and a fixing member heated by the heating member and forming a nip portion passing through a recording material together with the pressing member; and a hardware processor that: estimates a temperature of the fixing member based on a temperature of the heating member; and estimates a durability state of the fixing member according to the temperature of the fixing member estimated.

19 Claims, 10 Drawing Sheets

IMAGE FORMING APPARATUS, METHOD OF CONTROLLING IMAGE FORMING APPARATUS, AND PROGRAM

CROSS-REFERENCE TO RELATED APPLICATIONS

The entire disclosure of Japanese patent Application No. 2017-052411, filed on Mar. 17, 2017, is incorporated herein by reference in its entirety.

BACKGROUND

Technical Field

The present disclosure relates to an image forming apparatus including a fixing device.

Description of the Related Art

An electrophotographic image forming apparatus includes a fixing device that melts a toner image and fixes the toner image on a sheet (transfer material). For example, a heat roller fixing device has a heating roller as a heating member and a pressure roller as a pressing member. By nipping and conveying the sheet at the pressure contact portion (nip portion) between the heating roller and the pressure roller, the unfixed toner image on the sheet is heated, and the toner image is fixed on the sheet.

Various methods for diagnosing deterioration of members constituting the fixing device have been conventionally proposed.

For example, JP 2016-130823 A discloses a method of diagnosing deterioration by detecting a temperature rise value of an elastic layer forming a nip portion.

JP 2007-212844 A and JP 2005-115221 A disclose a method of diagnosing deterioration by detecting the temperature of a fixing roller and measuring the time during which the temperature of the fixing roller is equal to or higher than a predetermined temperature.

In the recent trend of energy saving to reduce the environmental burden, low thermal conductivity of the members is often achieved. Along with this, even a member forming the nip portion is often provided with a material that reduces thermal conductivity. Reducing thermal conductivity makes it difficult for heat to be transferred to the interior, so that it is difficult for heat to become uniform, and a difference in temperature is liable to occur. That is, a temperature difference occurs between the temperature of the surface of the member forming the nip portion and the internal temperature.

Therefore, in a case where the surface temperature is detected, the actual internal temperature may be different from the surface temperature. In this case, for the fixing devices disclosed in JP 2016-130823 A, JP 2007-212844 A, and JP 2005-115221 A, it is difficult to precisely detect the internal temperature of the member forming the nip portion with a high degree of accuracy using the method of simply detecting the surface temperature, and it is difficult to execute deterioration diagnosis with a high degree of accuracy. It is also conceivable to provide a sensor, but there is concern about the complicated arrangement and increased cost of the sensor.

SUMMARY

One or more embodiments of the present invention provide an image forming apparatus, a method of controlling an image forming apparatus, and a program capable of executing deterioration diagnosis with a high degree of accuracy without providing a sensor.

According to one or more embodiments of the present invention, an image forming apparatus comprises: a fixing device having: a heating member having a heat source; a pressing member; and a fixing member heated by the heating member and forming a nip portion passing through a recording material together with the pressing member; and a hardware processor that: estimates a temperature of the fixing member based on a temperature of the heating member; and estimates a durability state of the fixing member according to the temperature of the fixing member estimated.

BRIEF DESCRIPTION OF THE DRAWINGS

Embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, embodiments of the present invention will be described with reference to the drawings. However, the scope of the invention is not limited to the disclosed embodiments. In the following description, the same parts and components are denoted by the same reference signs. Their names and functions are also the same. Therefore, the detailed description thereof is not repeated. Note that embodiments and modifications described below may be selectively combined as appropriate.

[Image Forming Apparatus 100]

Figure 1:
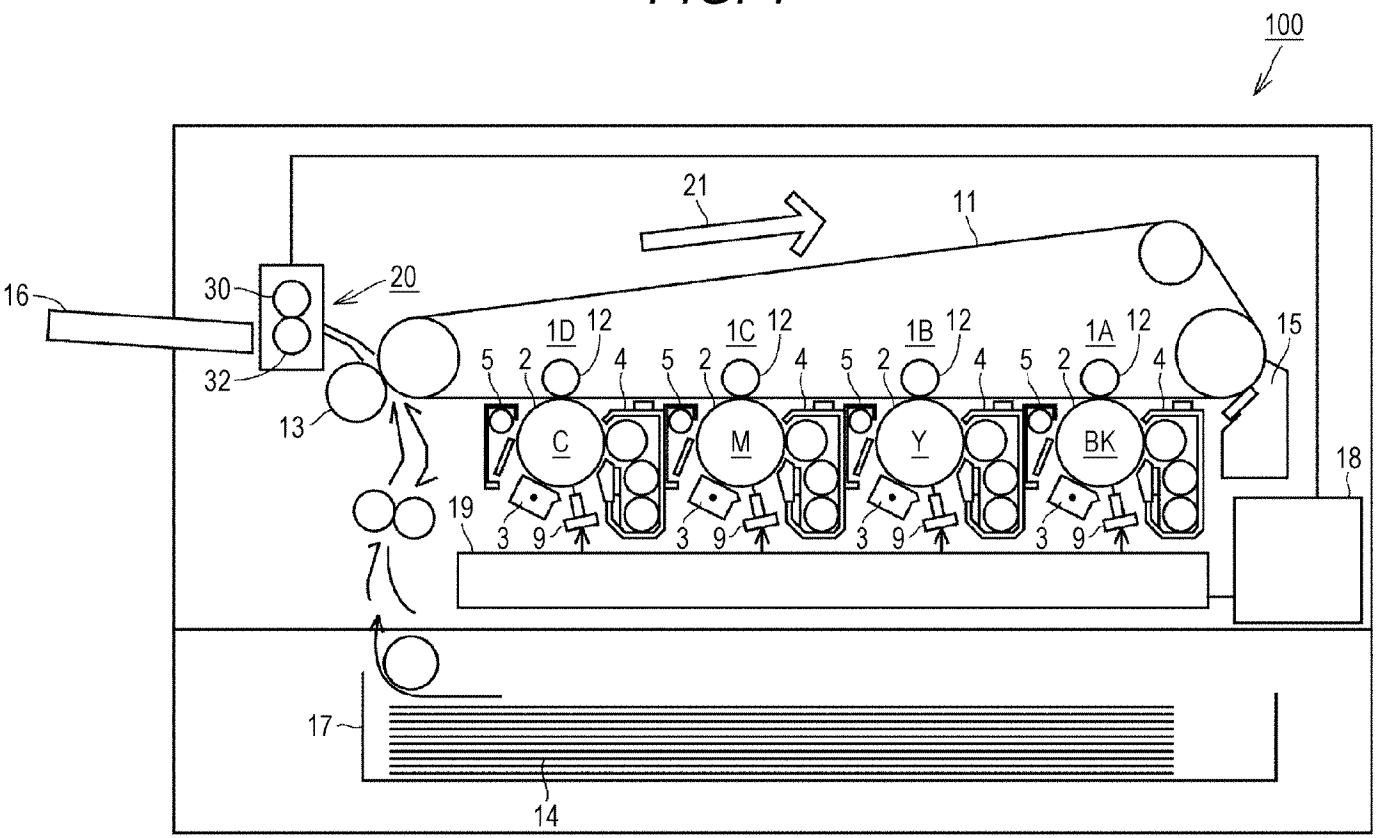
FIG. 1 is a view illustrating an exemplary apparatus configuration of an image forming apparatus according to one or more embodiments of the present invention.

FIG. 1 is a view illustrating an exemplary apparatus configuration of an image forming apparatus 100 according to one or more embodiments of the present invention.

Referring to FIG. 1, the image forming apparatus 100 as a color printer is illustrated as the image forming apparatus 100 according to one or more embodiments of the present invention. Hereinafter, the image forming apparatus 100 as a color printer will be described, but the image forming apparatus 100 is not limited to a color printer. For example, the image forming apparatus 100 may be a monochrome printer, or may be what is called a multi-functional peripheral (MFP) that serves as a monochrome printer, a color printer, and a FAX.

The image forming apparatus 100 includes image forming units 1A to 1D, an intermediate transfer belt 11, a primary transfer section 12, a secondary transfer section 13, a cleaning section 15, a tray 16, a cassette 17, a control device 18, an exposure controller 19, and a fixing device 20.

The image forming unit 1A forms a toner image of black (BK). The image forming unit 1B forms a toner image of yellow (Y). The image forming unit 1C forms a toner image of magenta (M). The image forming unit 1D forms a toner image of cyan (C). The intermediate transfer belt 11 rotates in the direction of an arrow 21, and the image forming units 1A to 1D are sequentially arranged along the rotation direction of the intermediate transfer belt 11.

Each of the image forming units 1A to 1D includes a photoconductor 2, a charging section 3, a developing section 4, a cleaning section 5, and an exposure section 9.

The photoconductor 2 is an image carrier that carries a toner image. For example, a photosensitive drum having a photosensitive layer formed on its surface is used for the photoconductor 2. The photoconductor 2 rotates along the rotation direction of the intermediate transfer belt 11.

The charging section 3 uniformly charges the surface of the photoconductor 2. The exposure section 9 irradiates the photoconductor 2 with a laser in accordance with a control signal from the exposure controller 19, and exposes the surface of the photoconductor 2 according to a designated image pattern. As a result, an electrostatic latent image corresponding to the input image is formed on the photoconductor 2.

The developing section 4 develops the electrostatic latent image formed on the photoconductor 2 as a toner image. For example, the developing section 4 develops the electrostatic latent image using a developer containing toner and a carrier.

The photoconductor 2 and the intermediate transfer belt 11 are in contact with each other at a portion where the primary transfer section 12 is provided. A predetermined transfer bias is applied to the contact portion, and the toner image on the photoconductor 2 is transferred onto the intermediate transfer belt 11 by this transfer bias. At this time, a black (BK) toner image, a yellow (Y) toner image, a magenta (M) toner image, and a cyan (C) toner image are sequentially superimposed and transferred onto the intermediate transfer belt 11. As a result, a color toner image is formed on the intermediate transfer belt 11.

The cleaning section 5 includes a cleaning blade. The cleaning blade is pressed against the photoconductor 2 to recover the toner remaining on the surface of the photoconductor 2 after the transfer of the toner image.

The cassette 17 is provided under the image forming apparatus 100. In the cassette 17, print pieces 14 such as sheets of paper are set. The print pieces 14 are sent one by one from the cassette 17 to the secondary transfer section 13. By synchronizing the feeding and conveying timings of the print piece 14 with the position of the toner image on the intermediate transfer belt 11, the toner image is transferred onto an appropriate position on the print piece 14. Thereafter, the print piece 14 is sent to the fixing device 20.

The fixing device 20 heats and melts the toner on the print piece 14 passing through the fixing device 20, and fixes the toner image on the print piece 14. Thereafter, the print piece 14 is discharged to the tray 16.

The cleaning section 15 includes a cleaning blade. The cleaning blade is pressed against the intermediate transfer belt 11 to recover the toner remaining on the intermediate transfer belt 11 after the toner image is transferred. The toner is conveyed by a conveying screw (not illustrated) and collected in a waste toner container (not illustrated).

The control device 18 controls the image forming apparatus 100. The control device 18 controls the exposure controller 19 and the fixing device 20, for example. Regarding the control of the fixing device 20, the control device 18 adjusts the rotation speed, the rotation time, and the like of a heating roller 31 by controlling a motor (not illustrated) provided in the heating roller 31. The method of controlling the motor may be, for example, a pulse width modulation (PWM) control method.

[Structure of Fixing Device 20]

Figure 2:
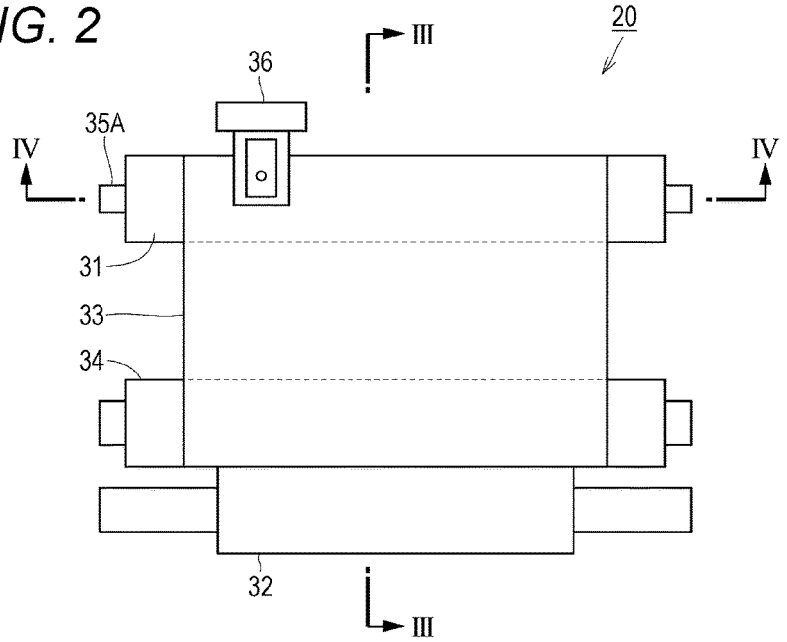
FIG. 2 is a view for explaining a configuration of a fixing device according to one or more embodiments of the present invention.

FIG. 2 is a view for explaining a configuration of the fixing device 20 according to one or more embodiments of the present invention.

Figure 3:
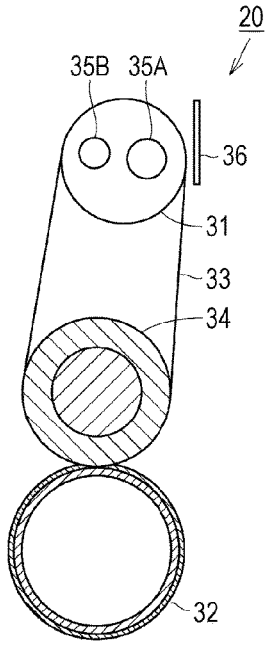
FIG. 3 is a cross-sectional view of the fixing device according to one or more embodiments of the present invention.

FIG. 3 is a cross-sectional view of the fixing device 20 according to one or more embodiments of the present invention.

Figure 4:
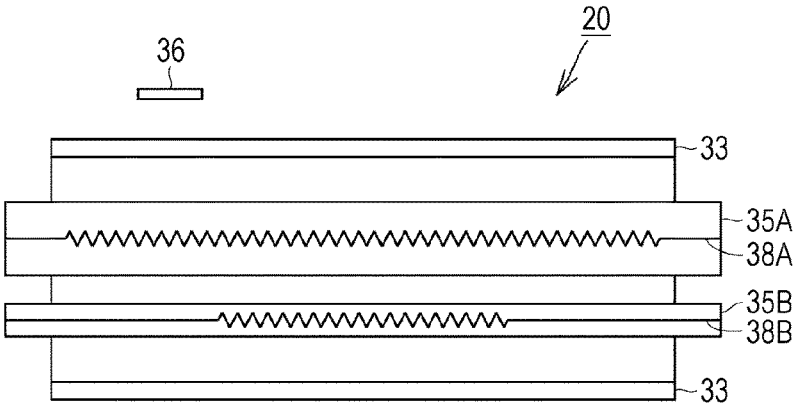
FIG. 4 is another cross-sectional view of the fixing device according to one or more embodiments of the present invention.

FIG. 4 is another cross-sectional view of the fixing device 20 according to one or more embodiments of the present invention.

FIG. 3 is a cross-sectional view taken along the line III-III in FIG. 2.

FIG. 4 is a cross-sectional view taken along the line IV-IV in FIG. 2.

As illustrated in FIGS. 2 to 4, the fixing device 20 includes a pressure roller 32, the heating roller 31, a fixing belt 33, a fixing roller 34, and a thermistor 36.

The heating roller 31 has a heating long heater 35A and a heating short heater 35B therein.

The heating roller 31 includes, for example, a cylindrical core metal made of aluminum or the like. The thickness of the core metal is, for example, 0.6 mm. A resin layer made of polytetrafluoroethylene (PTFE) or the like is formed on the outer peripheral surface of the core metal. The thickness of the PTFE is, for example, 15 μm. The outer diameter of the heating roller 31 is, for example, 25 mm. The length of the heating roller 31 in the longitudinal direction is, for example, 330 mm.

The pressure roller 32 is disposed to face the fixing roller 34. The pressure roller 32 includes, for example, a cylindrical core metal made of aluminum or the like. The outer diameter of the pressure roller 32 is, for example, 35 mm. The thickness of the core metal is, for example, 2 mm. A rubber layer and a resin layer made of perfluoroalkoxyalkane (PFA) or the like are formed on the outer peripheral surface of the core metal. The thickness of the rubber layer is, for example, 2 mm. The thickness of the PFA is, for example, 30 μm.

The fixing belt 33 is stretched over the heating roller 31 and the fixing roller 34, and rotates in conjunction with the heating roller 31 and the fixing roller 34. The fixing belt 33 includes polyimide, a rubber layer, PFA, and the like. The outer diameter of the fixing belt 33 is, for example, 60 mm. The thickness of the polyimide is, for example, 70 mm. The thickness of the rubber layer is, for example, 200 nm.

The fixing roller 34 is pressed against the fixing belt 33. The fixing roller 34 includes, for example, a columnar core metal made of iron or the like. The outer diameter of the fixing roller 34 is, for example, 30 mm. The outer diameter of the core metal is, for example, 18 mm. A rubber layer and a sponge layer are formed on the outer peripheral surface of the core metal. The thickness of the rubber layer is, for example, 4 mm. The thickness of the sponge layer is, for example, 2 mm. The region on the fixing roller 34 located between the fixing roller 34 and the pressure roller 32 corresponds to a nip portion.

The heating long heater 35A is provided inside the heating roller 31. The heating long heater 35A is, for example, a halogen lamp heater. The wattage of the heating long heater 35A is, for example, 999 W. The heating long heater 35A has a heat source 38A therein. The length of the portion of the heat source 38A that generates heat is, for example, 290 mm. The heating amount is changed according to the electric power supplied to the heat source 38A. Instead of the heating long heater 35A, a resistance heating element or an induction heating device may be provided.

The heating short heater 35B is disposed so as to face the heating long heater 35A, and is provided inside the heating roller 31. The heating short heater 35B is, for example, a halogen lamp heater. The wattage of the heating short heater 35B is, for example, 790 W. The heating short heater 35B has a heat source 38B therein. The length of the portion of the heat source 38B that generates heat is, for example, 180 mm. The heating amount is changed according to the electric power supplied to the heat source 38B. Instead of the heating short heater 35B, a resistance heating element or an induction heating device may be provided.

The heat sources 38A and 38B are provided at positions separated from the contact portion (that is, nip portion) between the fixing roller 34 and the pressure roller 32 by a predetermined distance or more. That is, the heat sources 38A and 38B are not provided near the nip portion. Therefore, the region on the fixing roller 34 heated by the heating roller 31 is only the contact portion with the heating roller 31 on the fixing belt 33. The heat sources 38A and 38B are also collectively referred to as a heat source 38.

The thermistor 36 is a temperature sensor for detecting the temperature of the fixing belt 33. The thermistor 36 is disposed so as to face the fixing belt 33 in a non-contact manner.

The operation of the fixing device 20 during printing will be described.

Assuming that the detected temperature of the thermistor 36 is T, the correction coefficient for temperature adjustment is A, and the corrected temperature for temperature adjustment is TA, the following expression is satisfied. By turning on or off the heat sources 38A and 38B, the corrected temperature TA is adjusted.

$$TA = A \times T$$

The operation of bringing the surfaces of the fixing belt 33 and the pressure roller 32 to a printable temperature after turning on the power of the image forming apparatus 100 is called warm-up, and the time taken for warm-up is referred to as a warm-up time. The warm-up is executed, for example, when the power is turned on again, when returning from a jam process, when the cover is closed, when returning from a sleep mode, and the like.

At the time of warm-up, the fixing device 20 drives the heating roller 31 to raise the temperature of the heating roller 31 to a printable temperature (that is, target temperature). The target temperature is, for example, 155° C. The fixing device 20 controls the heating long heater 35A and the heating short heater 35B using the corrected temperature TA as input.

The image forming apparatus 100 rotates the pressure roller 32 by transmitting driving force to a driving gear (not illustrated), and rotates the heating roller 31, the fixing belt 33, and the fixing roller 34 accordingly. As a result, the heat of the heating roller 31 is transmitted to the surfaces of the fixing belt 33 and the pressure roller 32. At this time, the linear speed of the fixing device 20 (the speed at which a print piece passes through the fixing device 20) is, for example, 135 mm/s. The temperature of the surfaces of the fixing belt 33 and the pressure roller 32 rises to the printable temperature due to the heating by the heating roller 31 and the rotation of the heating roller 31.

When the corrected temperature TA obtained by multiplying the temperature T detected by the thermistor 36 by the correction coefficient A reaches the printable temperature, the fixing device 20 outputs a signal (ready) indicating that printing is enabled to the image forming apparatus 100. This signal is output, for example, on the basis that the corrected temperature TA reaches 135° C. The image forming apparatus 100 enters a standby state when a print signal is not accepted, and starts printing when a print signal is accepted. The target temperature in the standby state is, for example, 155° C. to 150° C. The target temperature is controlled by turning on or off the heating long heater 35A and the heating short heater 35B.

When printing plain paper in full color, the linear speed of the fixing device is, for example, 135 mm/s. The target temperature at this time is, for example, 155° C. to 170° C., and the heating long heater 35A or the heating short heater 35B is controlled to be on or off using the corrected temperature TA as input.

More specifically, if the value obtained by subtracting the corrected temperature TA for selecting the heat source from the detected temperature T of the thermistor 36 is equal to or higher than a predetermined value, the image forming apparatus 100 determines that the temperature of the end portion of the fixing belt 33 is high, and sets the heating short heater 35B positioned at the end portion as an object of on/off control. If the value obtained by subtracting the corrected temperature TA for selecting the heat source from the detected temperature T of the thermistor 36 is less than the predetermined value, the image forming apparatus 100 sets the heating long heater 35A as an object of on/off control.

Temperature control of the fixing device 20 will be further described by taking the printing process for B4 paper as an example.

Since the temperature of the thermistor 36 at the end portion is not high before a sheet of paper passes through the fixing device 20, the image forming apparatus 100 sets the heating long heater 35A as an object of control, and turns on or off the heating long heater 35A using the corrected temperature TA as input. For example, if the length of the heating long heater 35A is 290 mm and the width of a sheet of B4 paper is 257 mm, since the heating width is wider than the paper passing width, a paper passing region and a non-paper passing region occur in the heating range. In this case, since heat is not taken by the sheet in the non-paper passing region, the temperature of the non-paper passing region gradually increases every time a sheet is fed compared with the temperature of the paper passing region.

For example, it is assumed that the thermistor 36 is disposed at a position separated from the center paper passing reference of the fixing belt 33 by 135 mm in the longitudinal direction, and that the end portion of the paper passing region is located at a position apart from the center paper passing reference by 128.5 mm in the same direction. The image forming apparatus 100 determines that the temperature of the end portion of the fixing belt 33 is high if the value obtained by subtracting the corrected temperature TA from the detected temperature T of the thermistor 36 is equal to or higher than the predetermined value, and switches the object of on/off control from the heating long heater 35A to the heating short heater 35B.

[Functional Configuration of Control Device 18]

Figure 5:
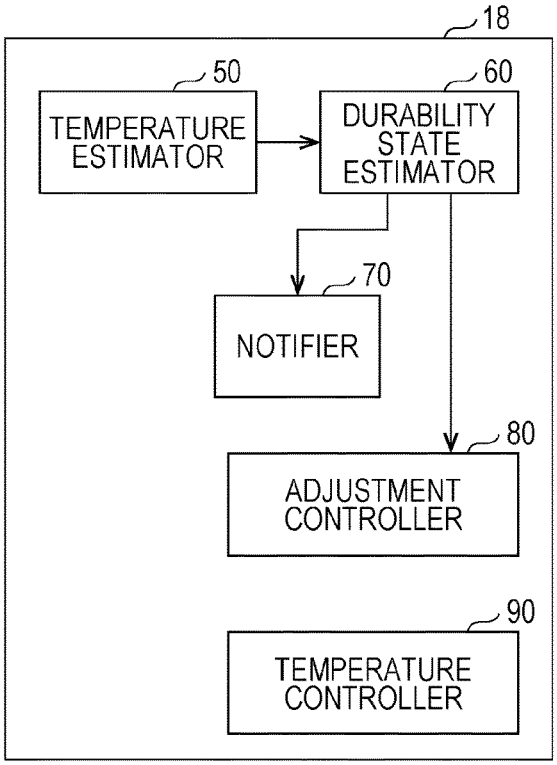
FIG. 5 is a diagram for explaining a functional configuration of a control device according to one or more embodiments of the present invention.

FIG. 5 is a diagram for explaining a functional configuration of the control device 18 according to one or more embodiments of the present invention.

As illustrated in FIG. 5, the control device 18 includes a temperature estimator 50, a durability state estimator 60, a notifier 70, an adjustment controller 80, and a temperature controller 90 as a functional configuration.

The temperature estimator 50 estimates the temperature of a member (fixing roller 34) of the fixing device 20.

The durability state estimator 60 estimates the durability state of the member based on the temperature of the member of the fixing device 20 estimated by the temperature estimator 50.

The notifier 70 gives notification of predetermined information based on the estimation result of the durability state estimator 60. Specifically, a message prompting replacement may be delivered, or an alarm may be issued.

The adjustment controller 80 executes an adjustment process for the fixing device 20 based on the estimation result of the durability state estimator 60.

The temperature controller 90 adjusts the temperature of the heat source 38 of the fixing device 20. Specifically, the temperature controller 90 determines the electric power to be supplied to the heating roller 31 according to the estimated temperature of the nip portion, and controls the temperature of the heat source 38. More specifically, if the estimated temperature of the nip portion is higher than the target temperature, the power supply to the heating roller 31 is reduced. At this time, the larger the difference between the estimated temperature of the nip portion and the target temperature is, the larger the range of reduction in the power supply is. On the other hand, if the estimated temperature of the nip portion is lower than the target temperature, the power supply to the heating roller 31 is increased. At this time, the larger the difference between the estimated temperature of the nip portion and the target temperature is, the larger the range of increase in the power supply is. The temperature of the heating roller 31 may be controlled by adjusting the duty ratio of the voltage applied to the heat sources 38A and 38B (see FIG. 4) of the heating roller 31. The duty ratio is the ratio of the time for the energization of the heat source to a predetermined period of time. For example, assuming that the duty ratio is 50% and the cycle of turning on and off the energization of the heat source is two seconds, the image forming apparatus 100 alternately repeats a one-second energization state and a one-second non-energization state. In another aspect, the image forming apparatus 100 is controlled by adjusting a constant electric power value applied to the heat source of the heating roller 31.

[Configuration of Temperature Estimator 50]

Figure 6:
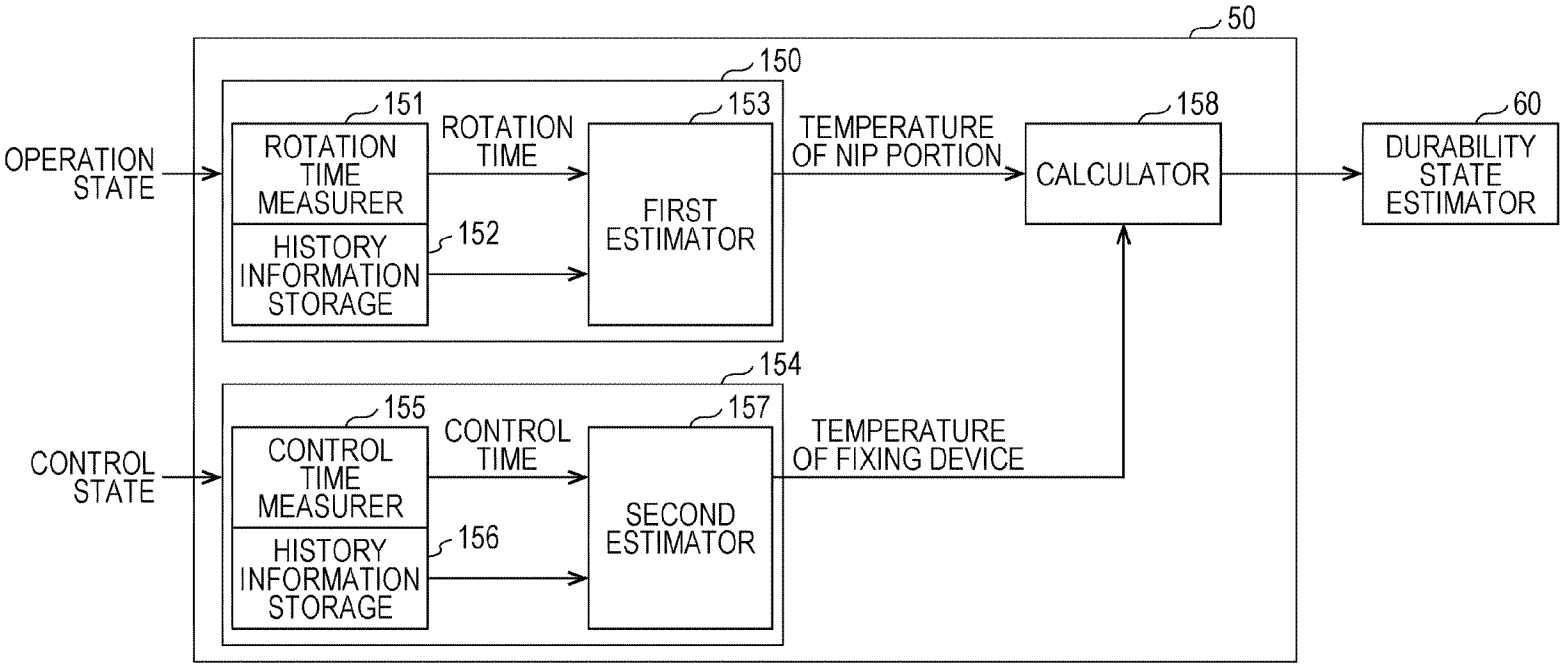
FIG. 6 is a functional block diagram for explaining a configuration of a temperature estimator according to one or more embodiments of the present invention.

FIG. 6 is a functional block diagram for explaining a configuration of the temperature estimator 50 according to one or more embodiments of the present invention.

As illustrated in FIG. 6, the temperature estimator 50 includes a nip temperature estimator 150, a device temperature estimator 154, and a calculator 158 as a functional configuration.

The nip temperature estimator 150 estimates the temperature of the nip portion based on the input of the operation state.

The device temperature estimator 154 estimates the temperature of the fixing device 20 based on the input of the control state.

The calculator 158 estimates the temperature of the member (fixing roller 34) of the fixing device 20 based on the nip temperature estimated by the nip temperature estimator 150 and the temperature of the fixing device 20 estimated by the device temperature estimator 154.

The temperature estimator 50 outputs the estimated temperature of the member (fixing roller 34) of the fixing device 20 to the durability state estimator 60.

The durability state estimator 60 estimates the durability state of the member based on the input of the temperature of the member (fixing roller 34) of the fixing device 20 estimated by the temperature estimator 50.

The nip temperature estimator 150 includes a rotation time measurer 151, a history information storage 152, and a first estimator 153.

The device temperature estimator 154 includes a control time measurer 155, a history information storage 156, and a second estimator 157.

The rotation time measurer 151 measures the rotation time of the heating roller 31 based on the input of the operation state. For example, all of the time from the start to the end of the rotation of the heating roller 31 are measured. A part of the time from the start to the end of the rotation of the heating roller 31 may be measured. Only the time during which the rotation speed is equal to or higher than a predetermined speed may be measured as the rotation time. Further, the rotation time measurer 151 may also measure the stationary time after the end of rotation and output it to the first estimator 153.

The history information storage 152 stores the rotation time as history information at a predetermined timing according to the operation state of the image forming apparatus 100. It is possible to use a register or a storage device 120 as a storage area.

The first estimator estimates the temperature of the nip portion based on the rotation time of the heating roller 31 measured by the rotation time measurer 151. The temperature of the nip portion may be estimated by using the history information stored in the history information storage 152.

The control time measurer 155 measures the control time for controlling the heat source 38 based on the input of the control state. The measurement of the control time is started in the image forming apparatus 100 on the basis that the heat source 38 is turned on. All or a part of the control time under measurement is measured as the control time. For example, the control time may be measured only when the temperature of the heating roller 31 is equal to or higher than a certain temperature.

The history information storage 156 stores the control time as history information at a predetermined timing according to the control state of the image forming apparatus 100. It is possible to use the register or the storage device 120 as a storage area.

The second estimator estimates the temperature of the fixing device 20 based on the control time of the heat source 38 measured by the control time measurer 155. The temperature of the fixing device 20 may be estimated by using the history information stored in the history information storage 156.

First, the temperature of the nip portion will be described.

[Estimation of Temperature of Nip Portion]

As described above, as the heating roller 31 rotates, heat is transmitted to the nip portion via the fixing belt 33. On the other hand, if the rotation of the heating roller 31 is stationary, the temperature of the nip portion does not rise since the fixing belt 33 does not move. That is, the temperature of the nip portion changes according to the rotation of the heating roller 31.

The nip temperature estimator 150 estimates the temperature of the nip portion based on information about the rotational motion of the heating roller 31. Accordingly, even though a thermistor is not provided on the nip portion, the temperature of the nip portion can be accurately estimated.

For example, the information about the rotational motion includes the rotation time from the start of the rotation of the heating roller 31 and the stationary time during which the heating roller 31 has been stationary before the rotation. The nip temperature estimator 150 estimates the temperature of the nip portion according to the rotation time and the stationary time of the heating roller 31.

Figure 7:
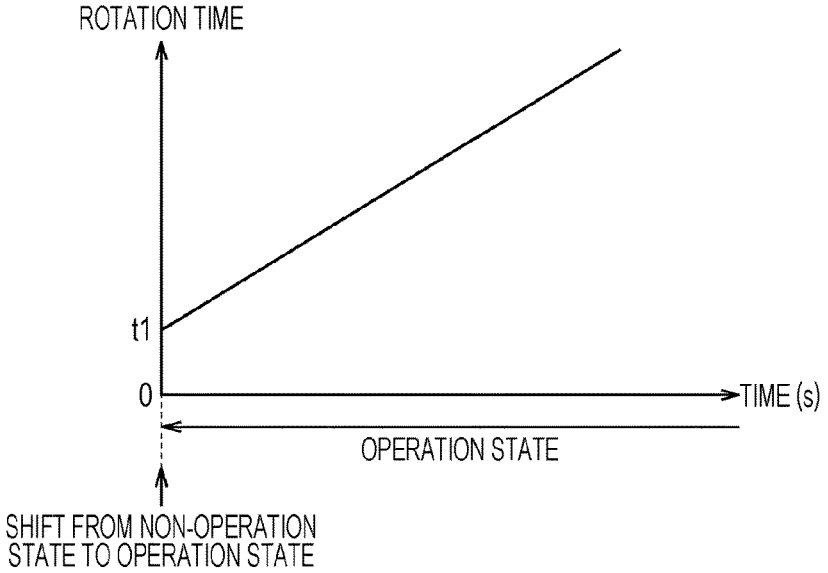
FIG. 7 is a diagram for explaining the measurement of the rotation time of a heating roller according to one or more embodiments of the present invention.

FIG. 7 is a diagram for explaining the measurement of the rotation time of the heating roller 31 according to one or more embodiments of the present invention.

As illustrated in FIG. 7, the measurement of the rotation time of the heating roller 31 is started, for example, based on the shift of the image forming apparatus 100 from a non-operation state to an operation state. The "operation state" means a state in which the heating roller 31 of the fixing device 20 is rotating in response to a printing instruction or the like. The "non-operation state" means a state in which the image forming apparatus 100 is operating with lower power consumption than in the operation state. The non-operation state includes, for example, a sleep state in which the image forming apparatus 100 is maintained in a low power state.

At the time when the measurement of the rotation time is started, there is a possibility that the nip portion is warmed to some extent by the last rotation of the heating roller 31. Therefore, the nip temperature estimator 150 adds a count at the start of measurement of the rotation time according to at least one of the last rotation time of the heating roller 31 and the last stationary time of the heating roller 31. That is, the nip temperature estimator 150 determines the initial value of the rotation time according to at least one of the last rotation time and the last stationary time of the heating roller 31, and counts the rotation time from the initial value.

The initial value is, for example, the time during which the heating roller 31 has rotated within a predetermined past time from the present (hereinafter also referred to as "past rotation time"). The past rotation time may be calculated by totaling the rotation times within the predetermined past time or may be calculated by subtracting the total stationary time of the heating roller 31 from the predetermined past time.

Figure 8:
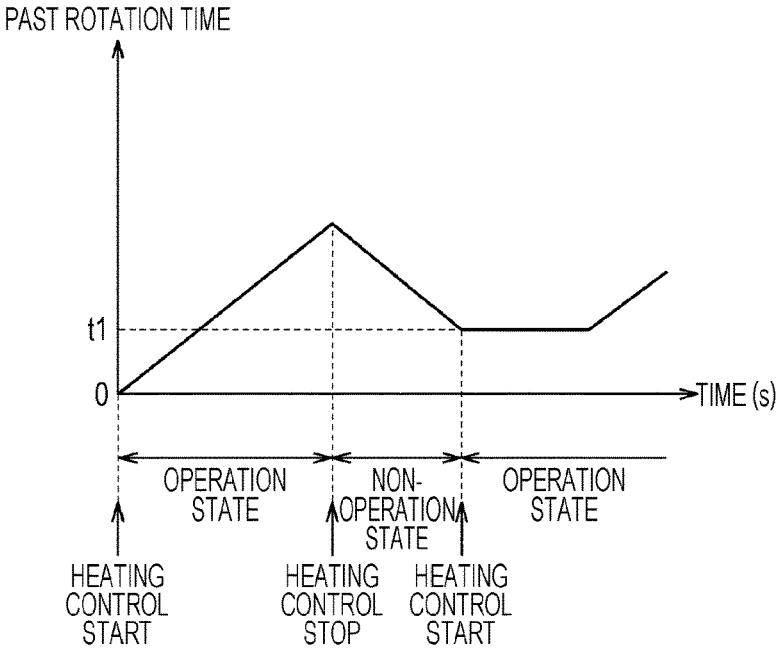
FIG. 8 is a diagram for explaining the relationship between the state of the image forming apparatus and the past rotation time according to one or more embodiments of the present invention.

FIG. 8 is a diagram for explaining the relationship between the state of the image forming apparatus 100 and the past rotation time.

FIG. 8 indicates the relationship between the state of the image forming apparatus 100 and the past rotation time. Suppose the past rotation time is the time t1 at the time when the image forming apparatus 100 shifts from the non-operation state to the operation state. At this time, the nip temperature estimator 150 starts measuring the rotation time using the time t1 as the initial value.

In a case where the past rotation time is calculated from the stationary time, when the rotation of the heating roller 31 is started, the nip temperature estimator 150 calculates, as the stationary time, the difference between the start time of the rotation and the stop time immediately before the rotation. The stop time is stored as history information in the history information storage 152 when the rotation of the heating roller 31 is stopped. The history information is read when the stationary time is calculated.

In one aspect, the nip temperature estimator 150 measures all of the time from the start to the end of the rotation of the heating roller 31. In another aspect, the nip temperature estimator 150 measures a part of the time from the start to the end of the rotation of the heating roller 31. For example, the nip temperature estimator 150 measures only the time during which the rotation speed is equal to or higher than the predetermined speed as the rotation time.

The nip temperature estimator 150 stores the measured rotation time in the history information storage 152 as history information. The history information is stored, for example, at a predetermined timing in the register, the storage device 120 (described later), or the like. For example, the timing is any of the timing when the rotation time reaches a predetermined value, when the printing of the image forming apparatus 100 is started, when the printing of the image forming apparatus 100 is ended, and when the power supply to the image forming apparatus 100 is ended.

The nip temperature estimator 150 estimates the temperature of the nip portion based on predefined information that defines the relationship between the rotation time of the heating roller 31 and the temperature of the nip portion. For example, the predefined information is a table, an expression, or the like that defines the relationship between the rotation time and the temperature of the nip portion. Since the rotation time of the heating roller 31 can also be calculated from the stationary time of the heating roller 31, the predefined information may define the relationship between the stationary time of the heating roller 31 and the temperature of the nip portion instead of the relationship between the rotation time of the heating roller 31 and the temperature of the nip portion.

Figure 9:
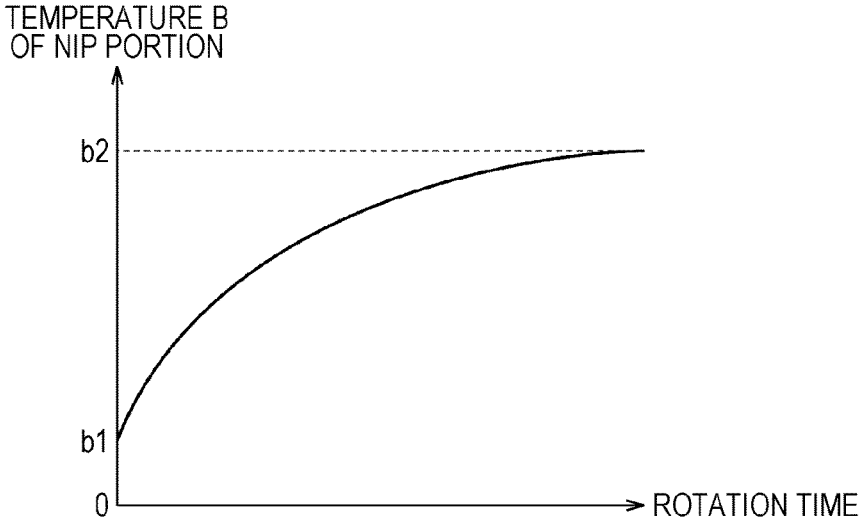
FIG. 9 is a diagram for explaining a method of estimating the temperature of a nip portion according to one or more embodiments of the present invention.

FIG. 9 is a diagram for explaining a method of estimating the temperature of the nip portion according to one or more embodiments of the present invention.

FIG. 9 indicates the relationship between the rotation time of the heating roller 31 and the temperature of the nip portion. The longer the rotation time is, the higher the temperature of the nip portion is. The shorter the rotation time is, the lower the temperature of the nip portion is. Based on this relationship, the nip temperature estimator 150 estimates the temperature corresponding to the measured rotation time as the temperature of the nip portion.

[Estimation of Temperature of Fixing Device]

The temperature of the fixing device 20 is influenced by temperature control time. The temperature of the fixing device 20 becomes easy to warm as the control time for controlling the heat source 38 elapses.

In this example, the device temperature estimator 154 estimates the temperature of the fixing device 20 by using the control time for controlling the heat source 38.

In the device temperature estimator 154, the measurement of the control time is started on the basis that the heat source 38 is turned on. The device temperature estimator 154 counts all or a part of the control time under measurement as the control time. For example, the device temperature estimator 154 may count the control time only when the temperature of the heating roller 31 is equal to or higher than a certain temperature.

The device temperature estimator 154 stores the measured control time in the history information storage 156 as history information. The history information is stored, for example, at a predetermined timing in the register or the storage device 120 (described later). For example, the timing is any of the timing when the operation time reaches a predetermined time, when the printing of the image forming apparatus 100 is started, when the printing of the image forming apparatus 100 is ended, and when the power supply to the image forming apparatus 100 is ended.

The device temperature estimator 154 estimates the temperature of the fixing device 20 based on predefined information that defines the relationship between the temperature of the fixing device 20 and the control time. The predefined information is, for example, a table, an expression, or the like that defines the relationship between the control time and the temperature of the fixing device 20.

When the image forming apparatus 100 is in the operation state, since the heating roller 31 is rotating, the control time stored as a history is equal to or longer than the rotation time of the above-described heating roller 31 stored as a history. Therefore, if the rotation time becomes longer than the control time due to some factor, the rotation time may be replaced with the control time.

Figure 10:
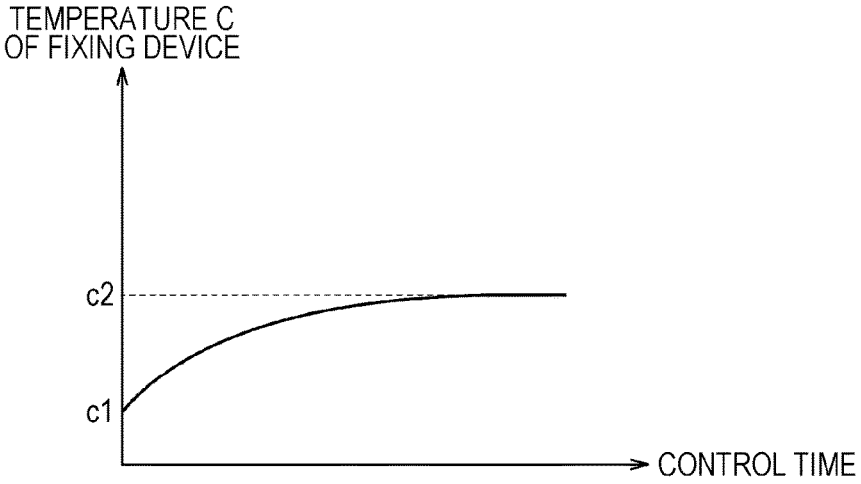
FIG. 10 is a diagram for explaining a method of estimating the temperature of the fixing device according to one or more embodiments of the present invention.

FIG. 10 is a diagram for explaining a method of estimating the temperature of the fixing device 20 according to one or more embodiments of the present invention.

FIG. 10 indicates the relationship between the control time of the heat source 38 and the temperature of the fixing device 20. The longer the control time is, the higher the temperature of the fixing device 20 is. The shorter the control time is, the lower the temperature of the fixing device 20 is. Based on this relationship, the device temperature estimator 154 estimates the temperature corresponding to the measured control time as the temperature of the fixing device 20.

In the method described in this example, the temperature of the fixing device 20 is estimated from the control time. Alternatively, the temperature of the fixing device 20 may be estimated using the temperature detected by the thermistor.

[Estimation of Temperature of Fixing Roller]

The temperature estimator 50 estimates the temperature of the fixing roller 34 based on the temperature of the nip and the temperature of the fixing device 20.

Specifically, the calculator 158 estimates the temperature of the fixing roller 34 based on the estimation of the nip temperature provided by the nip temperature estimator 150 and the temperature of the fixing device 20 provided by the device temperature estimator 154.

More specifically, the calculator 158 estimates the temperature Q of the fixing roller 34 using expression (1) below.

$$Q=\alpha B+\beta C \tag{1}$$

In expression (1), α and β represent constants.

In expression (1), "B" represents the temperature of the nip portion.

In this example, the temperature of the nip portion is a concept including not only the predicted actual temperature but also the degree of warming (evaluation value) of the nip portion or a value correlated with the temperature. The degree of warming (evaluation value) of the nip portion is calculated based on the ratio to a reference value indicating a predetermined degree of warming.

The temperature of the nip portion depends on the heat flow rate of heat conduction to the nip portion through the fixing belt 33. By the rotation of the heating roller 31, heat is supplied to the nip portion.

The value "B" is represented by expression (2) below.

$$B=D(\text{temperature})\times F(\text{trot}+\delta\text{rot}) \tag{2}$$

In expression (2), "D (temperature)" is a function that uses the temperature of the heating roller 31 as input, and represents the "heat transfer amount" transmitted from the heating roller 31 to the nip portion via the fixing belt 33. The higher the temperature of the heating roller 31 is, the higher "D (temperature)" is. That is, the higher the temperature of the heating roller 31 is, the larger the "heat transfer amount" transmitted from the heating roller 31 to the nip portion via the fixing belt 33 is.

In expression (2), "F (trot+δrot)" is a function correlated with the estimated temperature of the nip portion and is a function that uses "trot+δrot" as input. The value "trot" represents the time from the start of the rotation of the heating roller 31. The value "δrot" represents the past rotation time (see FIG. 8) within the predetermined past time at the time when the rotation of the heating roller 31 is started. The temperature of the nip portion is estimated from "trot" and "δrot" using the above estimation method.

The temperature "B" of the nip portion has a small value if the rotation time is short and a large value if the rotation time is long.

The temperature "B" of the nip portion may be represented by an expression that gradually approaches the value "b2" from the value "b1".

Further, a table for calculating the value of the temperature "B" of the nip portion may be held.

In expression (1), the value "C" represents the temperature of the fixing device 20.

In this example, the temperature of the fixing device 20 is a concept including not only the predicted actual temperature but also the degree of warming (evaluation value) of the fixing device 20 or a value correlated with the temperature. The degree of warming (evaluation value) of the fixing device 20 is calculated based on the ratio to a reference value indicating a predetermined degree of warming.

The temperature of the fixing device depends on radiant heat from the heat source 38 or heat conduction or convection through the air.

The value "C" is represented by expression (3) below.

$$C=D(\text{temperature})\times G(t+\delta) \tag{3}$$

In expression (3), "G (t+δ)" is a function correlated with the temperature of the heating roller 31 and is a function that uses "t+δ" as input. The output value of "G (t+δ)" is determined by "t+δ" representing the control time of the heat source 38. The value "t" represents the control time that elapses after the heat source 38 is turned on. That is, "t" represents the temperature control time that elapses after the heat source 38 is turned on (for example, from the morning). The value "δ" represents the operation time within the predetermined past time from the time when the heat source 38 is turned on. The temperature of the fixing device is estimated from "t" and "δ" using the above estimation method.

The temperature "C" of the fixing device 20 has a small value if the control time of the heat source 38 is short and a large value if the control time is long.

The temperature "C" of the fixing device 20 may be represented by an expression that gradually approaches the value "c2" from the value "c1".

Further, a table for calculating the temperature "C" of the fixing device 20 may be held.

[Process of Durability State Estimator 60]

The durability state estimator 60 estimates the durability state of a fixing member based on the temperature of the fixing member estimated by the temperature estimator 50.

Specifically, the durability state estimator 60 estimates the durability state according to a travel distance that is based on the rotation time of the fixing roller 34 or the rotation time and rotation speed of the fixing roller 34.

A case where the travel distance is calculated will be described as an example.

For example, the travel distance is calculated by adding the rotation speed of 135 mm/s per second. The travel distance per second is 135 mm.

The durability state estimator 60 calculates a corrected travel distance by multiplying the actual travel distance by the weight R corresponding to the temperature of the fixing member.

The durability state estimator 60 counts the corrected travel distance, determines whether a total travel distance exceeds a predetermined value, and determines that maintenance is necessary if the total travel distance exceeds the predetermined value. On the other hand, if the total travel distance does not exceed the predetermined value, it is determined that maintenance is unnecessary. If it is determined that the total travel distance exceeds the predetermined value, the durability state estimator 60 notifies the notifier 70 to output a guidance prompting a service person or the like to make replacement. The predetermined value may be a threshold value of 480 km.

Figure 11:
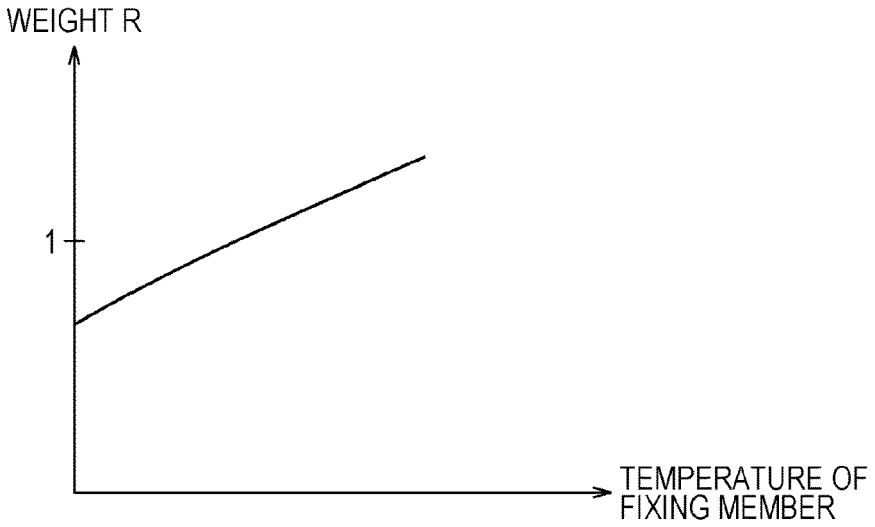
FIG. 11 is a diagram for explaining the weight corresponding to the temperature of a fixing member according to one or more embodiments of the present invention.

FIG. 11 is a diagram for explaining the weight R corresponding to the temperature of the fixing member.

FIG. 11 indicates that the weight R becomes larger as the temperature of the fixing member becomes higher.

In a case where the weight R is one, for example, the travel distance per second is 135 mm.

On the other hand, in a case where the weight R is larger than one, for example, the corrected travel distance per second is longer than 135 mm. On the other hand, in a case where the weight R is smaller than one, for example, the corrected travel distance per second is shorter than 135 mm.

The corrected travel distance is added, and if the total travel distance exceeds the predetermined value, a guidance is provided by the notifier 70.

Figure 12:
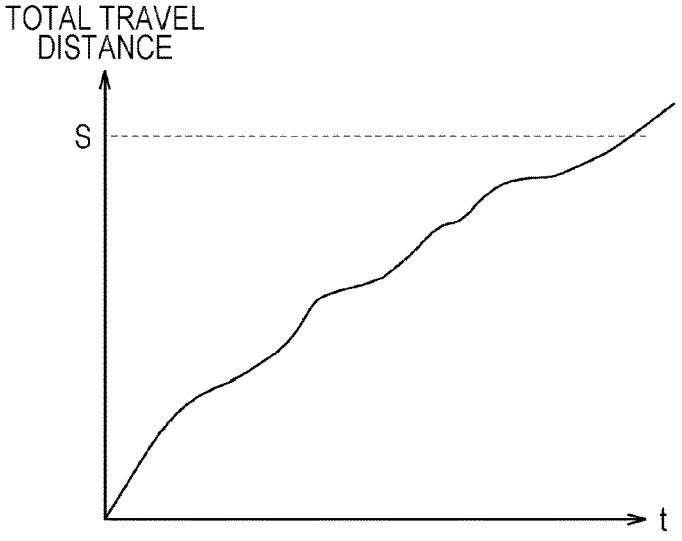
FIG. 12 is a diagram for explaining a total travel distance according to one or more embodiments of the present invention.

FIG. 12 is a diagram for explaining the total travel distance according to one or more embodiments of the present invention.

As illustrated in FIG. 12, the inclination of the total travel distance changes according to the weight R. Specifically, if the temperature of the fixing member is high, the corrected travel distance to be added is longer than the actual travel distance. On the other hand, if the temperature of the fixing member is low, the corrected travel distance to be added is shorter than the actual travel distance.

In this example, a threshold value S is set, and if the total travel distance exceeds the threshold value S, a guidance prompting replacement is output from the notifier 70.

Figure 13:
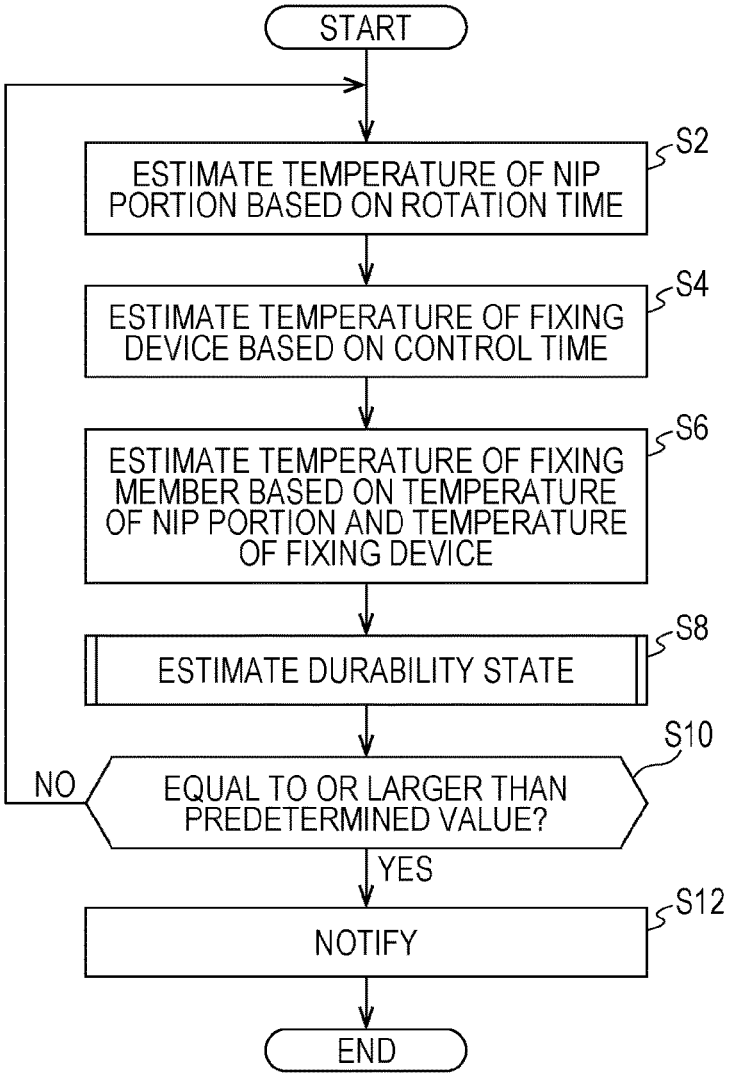
FIG. 13 is a diagram for explaining a process of the image forming apparatus according to one or more embodiments of the present invention.

FIG. 13 is a diagram for explaining a process of the image forming apparatus 100 according to one or more embodiments of the present invention.

As illustrated in FIG. 13, the image forming apparatus 100 estimates the temperature of the nip portion based on the rotation time (step S2). Specifically, the temperature of the nip portion is estimated in the nip temperature estimator 150 of the temperature estimator 50.

Next, the image forming apparatus 100 estimates the temperature of the fixing device based on the control time (step S4). Specifically, the temperature of the fixing device 20 is estimated in the device temperature estimator 154 of the temperature estimator 50.

Next, the image forming apparatus 100 estimates the temperature of the fixing member based on the temperature of the nip portion and the temperature of the fixing device (step S6). Specifically, the calculator 158 of the temperature estimator 50 estimates the temperature of the fixing roller based on the estimated temperature of the nip portion and the estimated temperature of the fixing device 20.

Next, the image forming apparatus 100 estimates the durability state of the fixing member (step S8). Specifically, the durability state estimator 60 calculates the weight corresponding to the temperature of the fixing roller, multiplies the actual travel distance by the weight, adds the corrected travel distance, and calculates the total travel distance.

Figure 14:
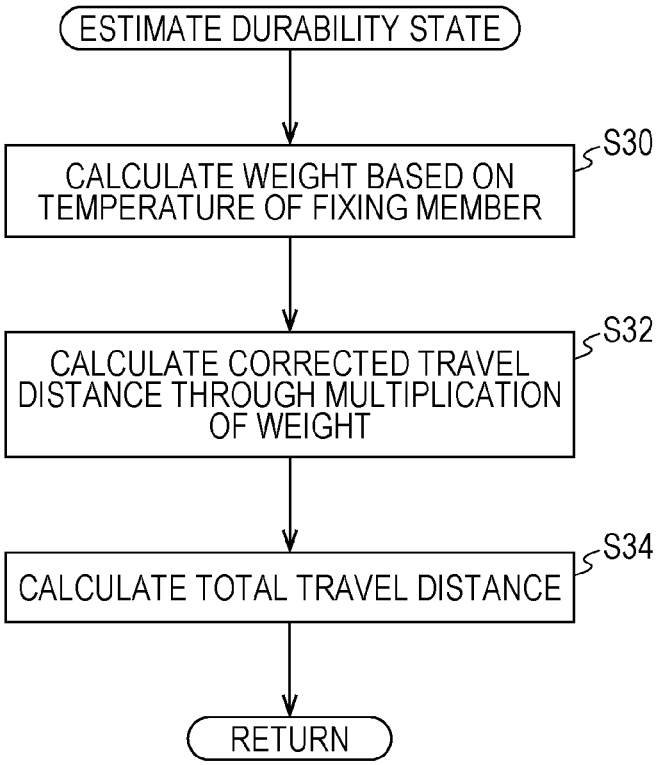
FIG. 14 is a diagram for explaining a subroutine for the estimation of the durability state according to one or more embodiments of the present invention.

FIG. 14 is a diagram for explaining a subroutine for the estimation of the durability state.

As illustrated in FIG. 14, the durability state estimator 60 calculates the weight R based on the temperature of the fixing member (step S30).

Next, the durability state estimator 60 calculates the corrected travel distance through the multiplication of the weight (step S32).

Next, the durability state estimator 60 calculates the total travel distance (step S34).

Then, the process is terminated (return).

Next, the image forming apparatus 100 determines whether the total travel distance exceeds the predetermined value (step S10). Specifically, the durability state estimator 60 determines whether the total travel distance exceeds the predetermined value.

The image forming apparatus 100 gives notification if it is determined in step S10 that the total travel distance exceeds the predetermined value (step S12). The durability state estimator 60 gives notification to the notifier 70 if it is determined that the total travel distance exceeds the predetermined value.

The notifier 70 outputs a guidance prompting a service person or the like to make replacement according to the notification from the durability state estimator 60.

Then, the process is terminated (end).

On the other hand, if it is determined in step S10 that the total travel distance does not exceed the predetermined value, the image forming apparatus 100 returns to step S2 and repeats the above process.

In the description of this example, the total travel distance is calculated. However, the present invention is not limited thereto, and the durability state may be estimated by calculating the total rotation time of the fixing member. Specifically, it may be realized by multiplying the rotation time by the weight R and performing addition as in the above.

In the above description, 480 km is set as the threshold value as an example. Alternatively, for example, 400 km may be set as an advance notice threshold. The adjustment control may be executed at the time when the advance notice threshold is reached. Specifically, the durability state estimator 60 may instruct the adjustment controller 80 to execute control to adjust the temperature of the heat source 38.

More specifically, the adjustment controller 80 may not control the heater in the standby state, or may perform an adjustment such that the weight is reduced by lowering the temperature of the fixing member. Alternatively, a process for prolonging the delay time for reaching the threshold value may be executed by suppressing the rotation time of the fixing member or limiting the printing frequency to adjust the temperature of the nip portion.

[Hardware Configuration of Image Forming Apparatus 100]

Figure 15:
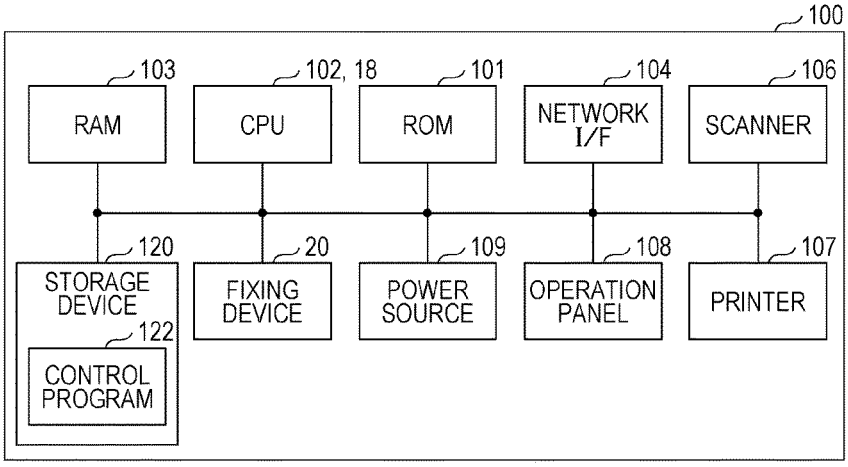
FIG. 15 is a block diagram illustrating a main hardware configuration of the image forming apparatus according to one or more embodiments of the present invention.

FIG. 15 is a block diagram illustrating a main hardware configuration of the image forming apparatus 100.

As illustrated in FIG. 15, the image forming apparatus 100 includes a read only memory (ROM) 101, a CPU 102, a random access memory (RAM) 103, a network interface (I/F) 104, a scanner 106, a printer 107, an operation panel 108, and the storage device 120.

The ROM 101 stores control programs and the like that are executed by the image forming apparatus 100. The CPU 102 is the control device 18 described above. The CPU 102 controls the operation of the image forming apparatus 100 by executing various programs such as control programs of the image forming apparatus 100. The RAM 103 functions as a working memory and temporarily stores various data necessary for executing control programs.

An antenna (not illustrated) or the like is connected to the network I/F 104. The image forming apparatus 100 exchanges data with other communication devices via the antenna. Examples of other communication devices include a portable communication terminal such as a smartphone, a server, and the like. The image forming apparatus 100 may be configured such that a control program 122 according to one or more embodiments of the present invention can be downloaded from a server via the antenna.

The scanner 106 optically reads the document set in the image forming apparatus 100 and generates image data of the document.

The printer 107 is a device that converts, using an electrophotographic method, for example, image data read by the scanner 106 or print data transmitted from another communication device into data for printing, and prints an image such as a document based on the converted data.

The operation panel 108 is configured as a touch panel, and accepts a touch operation on the image forming apparatus 100. For example, the operation panel 108 includes a display panel and a touch sensor provided over the display panel. The operation panel 108 accepts, for example, a setting operation, a printing instruction, and the like relating to the control program 122.

A power source 109 supplies electric power to various devices of the image forming apparatus 100 on the basis that a power button (not illustrated) of the image forming apparatus 100 is pressed.

The storage device 120 is, for example, a storage medium such as a hard disk or an external storage device. The storage device 120 stores, for example, the control program 122 for realizing the process according to one or more embodiments of the present invention.

It should be noted that the control program 122 according to one or more embodiments of the present invention may be provided as a part of an arbitrary program, not as a single program. In this case, the process according to one or more embodiments of the present invention is realized in cooperation with an arbitrary program. Even programs that do not include such partial modules do not depart from the gist of the program according to one or more embodiments of the present invention. In addition, some or all of the functions provided by the control program 122 according to one or more embodiments of the present invention may be realized by dedicated hardware. Furthermore, the image forming apparatus 100 may be configured in the form of what is called a cloud service in which at least one server realizes the process according to one or more embodiments of the present invention.

Figure 16:
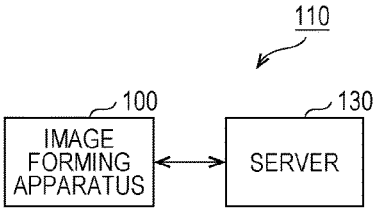
FIG. 16 is a conceptual diagram of an image forming system according to one or more embodiments of the present invention.

FIG. 16 is a conceptual diagram of an image forming system according to one or more embodiments of the present invention.

As illustrated in FIG. 16, the image forming system 110 includes the image forming apparatus 100 and a server 130. The image forming apparatus 100 cooperates with the server 130 to execute various processes. Specifically, as described above, various data in the image forming apparatus 100 may be transmitted to the server 130, and the process for estimating the durability state of the fixing member may be executed in the server 130. Then, the server 130 may notify a service person of a guidance prompting replacement, or may notify the operation panel of the image forming apparatus 100 of a guidance prompting replacement.

SUMMARY

As described above, the image forming apparatus 100 estimates the temperature of the nip portion based on the rotation time and estimates the temperature of the fixing device based on the control time. Consequently, the temperature of the fixing member is estimated. The image forming apparatus 100 calculates the weight for multiplying the travel distance according to the estimated temperature of the fixing member. The image forming apparatus 100 gives notification to a service person if the total travel distance exceeds the predetermined threshold value. Since the weight corresponding to the estimated temperature of the fixing member is calculated, it is possible to execute deterioration diagnosis with a high degree of accuracy without providing a sensor.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

What is claimed is:

1. An image forming apparatus comprising:

a fixing device comprising:

a rotatable heating roller comprising a heat source;

a pressing roller; and a fixing roller heated by the heating roller and that forms, together with the pressing roller, a nip portion through which a recording material passes; and a hardware processor that:

comprises a storage that stores history information including a rotation time and a stationary time of the heating roller;

estimates a temperature of the fixing roller based on a temperature of the fixing device corresponding to a temperature of the heating roller and based on a temperature of the nip portion to which the temperature of the heating roller is conducted; and estimates a durability state of the fixing roller according to the estimated temperature of the fixing roller, wherein the hardware processor estimates the temperature of the nip portion according to the rotation time and the stationary time of the heating roller.

2. The image forming apparatus according to claim 1, wherein the history information includes a control time of the heat source, and the hardware processor estimates the temperature of the fixing device corresponding to the temperature of the heating roller according to the control time of the heat source.

3. The image forming apparatus according to claim 2, wherein the storage stores predefined information that defines a relationship between the control time and the temperature of the fixing device when warm-up of the fixing device is started, and the hardware processor estimates the temperature of the fixing device based on the predefined information.

4. The image forming apparatus according to claim 3, wherein the hardware processor measures, as the control time, all or a part of a time from a start to an end of control of the heat source.

5. The image forming apparatus according to claim 1, wherein the storage stores a start time of rotation of the heating roller and a stop time of rotation of the heating roller, and the hardware processor calculates the stationary time based on the start time of rotation of the heating roller and the stop time of rotation of the heating roller.

6. The image forming apparatus according to claim 5, wherein the hardware processor measures, as the rotation time, all or a part of a time from a start to an end of rotation of the heating roller.

7. The image forming apparatus according to claim 5, wherein the hardware processor measures the rotation time if the temperature of the heating roller is equal to or higher than a predetermined temperature.

8. The image forming apparatus according to claim 1, wherein the storage stores predefined information that defines a relationship between at least one of the rotation time and the stationary time of the heating roller and the temperature of the nip portion, and the hardware processor estimates the temperature of the nip portion based on the predefined information.

9. The image forming apparatus according to claim 1, wherein the fixing roller is rotatably provided, and the hardware processor:

calculates rotation information about a rotation distance that is based on a rotation time of the fixing roller or a rotation speed and a rotation time of the fixing roller, and estimates the durability state of the fixing roller by multiplying the calculated rotation information by a weight correlated with the estimated temperature of the fixing roller.

10. The image forming apparatus according to claim 9, wherein the weight for a case where the temperature of the fixing roller is high is larger than the weight for a case where the temperature of the fixing roller is low.

11. The image forming apparatus according to claim 1, wherein the heat source is provided at a position separated from the nip portion by a predetermined distance or more.

12. The image forming apparatus according to claim 1, wherein a temperature sensor is not disposed in a vicinity of the nip portion.

13. The image forming apparatus according to claim 1, further comprising:

a fixing belt stretched over the heating roller and the fixing roller, wherein the nip portion is a region where the fixing roller is pressed against the pressing roller via the fixing belt.

14. The image forming apparatus according to claim 1, wherein the hardware processor further adjusts the heat source based on the temperature of the nip portion.

15. The image forming apparatus according to claim 1, wherein the hardware processor further gives a notification based on the estimated durability state of the fixing roller.

16. The image forming apparatus according to claim 1, wherein the hardware processor further adjusts the heating roller based on the estimated durability state of the fixing roller.

17. The image forming apparatus according to claim 1, further comprising:

a fixing belt stretched over the heating roller and the fixing roller, wherein the heat source comprises a plurality of heaters, and the hardware processor sets at least one of the heaters as an object of on/off control based on a temperature of the fixing belt.

18. A method of controlling an image forming apparatus that comprises: a fixing device comprising a rotatable heating roller equipped with a heat source, a pressing roller, and a fixing roller that is heated by the heating roller and forms, together with the pressing roller, a nip portion through which a recording material passes; and a hardware processor comprising a storage, the method comprising:

storing, in the storage, history information including a rotation time and a stationary time of the heating roller, estimating, by the hardware processor, a temperature of the fixing roller based on a temperature of the fixing device corresponding to a temperature of the heating roller and based on a temperature of the nip portion to which the temperature of the heating roller is conducted; and estimating, by the hardware processor, a durability state of the fixing roller according to the estimated temperature of the fixing roller, wherein the temperature of the nip portion is estimated according to the rotation time and the stationary time of the heating roller.

19. A non-transitory recording medium storing a computer readable program executed by a computer of an image forming apparatus that comprises: a fixing device comprising a rotatable heating roller equipped with a heat source, a pressing roller, and a fixing roller that is heated by the heating roller and forms, together with the pressing roller, a nip portion through which a recording material passes; and a storage, the program causing the computer to execute:

storing, in the storage, history information including a rotation time and a stationary time of the heating roller, estimating a temperature of the fixing roller based on a temperature of the fixing device corresponding to a temperature of the heating roller and based on a temperature of the nip portion to which the temperature of the heating roller is conducted; and estimating a durability state of the fixing roller according to the estimated temperature of the fixing roller, wherein the temperature of the nip portion is estimated according to the rotation time and the stationary time of the heating roller.

* * * * *